United States Patent [19]

Sullivan et al.

[11] Patent Number: 4,837,905

[45] Date of Patent: Jun. 13, 1989

[54] METHOD AND APPARATUS OF SEAT ASSEMBLY

[75] Inventors: Daniel P. Sullivan; Terrel L. Scherman, both of Rochester Hills; Elmer H. Drew, Grosse Pointe Woods, all of Mich.

[73] Assignee: General Motors Corporation, Detroit, Mich.

[21] Appl. No.: 200,341

[22] Filed: Jun. 1, 1988

[51] Int. Cl.[4] ..... B68G 7/00

[52] U.S. Cl. ..... 29/91.5; 79/91.1; 79/448; 53/574

[58] Field of Search ..... 29/91.5, 448; 53/574

[56] References Cited

U.S. PATENT DOCUMENTS 4,385,427 5/1983 Fraiser ..... 29/91.5

4,665,606 5/1987 Saito et al. ..... 29/448

FOREIGN PATENT DOCUMENTS 28992 2/1984 Japan ..... 29/91.5

*Primary Examiner*—Timothy V. Eley

*Attorney, Agent, or Firm*—Ernest E. Helms

[57] ABSTRACT

The present invention provides an apparatus and method of enclosing a vehicle seat elastomeric foam bun assembly with a prefitted cover. In a preferred embodiment the bun assembly is enclosed with a generally impermeable cylindrical bag having a lower coefficient of friction with the bun assembly foam than the coefficient of friction of the cover with the bun assembly foam. One end of the bag is connected with a vacuum source to sealably adhere the bag to the bun assembly and to connect the bun assembly. The bun assembly is then enclosed by the cover. The bag is then removed from between the cover and the bun assembly by ejecting the bun assembly out the open end of the bag while holding one end of the bag fixed.

7 Claims, 3 Drawing Sheets

METHOD AND APPARATUS OF SEAT ASSEMBLY

FIELD OF THE INVENTION

The field of the present invention is that of an apparatus and method of assembling prefitted fabric or other membrane type covers over vehicle seating polymeric foam bun assemblies.

DISCLOSURE STATEMENT

Vehicle seats, especially automotive seats, usually consist of a metallic frame which is covered with a polymeric foam for cushion material such as polyurethane. The polymeric foam and frame are commonly referred to as the bun assembly. To provide a seating surface for the vehicle occupant the bun assembly is then enclosed by a prefitted membrane cover. The cover may be vinyl, leather or a cloth material.

There are various methods of enclosing the cover on the seat. One method of attaching the cover to the seat provides a cover which is opened on the side of the bun assembly away from the seat occupant. The ends of the cover are connected with the bun assembly by tying them with hog rings to objects premolded in the foam bun or alternately laced across to each other. A hardened back is then placed on the rear of the seat to conceal the attachment of the cover to the foam bun.

Another method of enclosing the bun assembly with the seat cover is to have an envelope type seat cover. The envelope seat cover is shaped similar to a pillow and usually have a slight interference (compression) fit with the bun assembly. Typically along its lower end, the cover has a circumference which is smaller than its greatest circumference so that the cover will fit the contour of the seat bun assembly.

Placing the seat cover over the bun assembly has been found to be a tedious, and by many, an unpleasant task since the seat cover is slightly smaller than the seat bun assembly. Also, making the task more difficult is the fact that the foam of the bun assembly tends to have a high degree of adhesion with the seat cover.

In an attempt to over come the above-noted problems, a new technique was developed. In the new technique the bun assembly was enclosed by a plastic bag which could be easily fitted over the bun assembly. The interior of the bag surrounding the bun assembly was exposed to a vacuum thereby compressing the bun assembly. While the bun assembly was compressed the seat cover was then placed over the plastic bag.

The above-noted assembly technique provided an improvement in lowering the effort expended in placing the seat cover over the bun assembly but created two additional problems. The plastic bag was retained on the foam bun inside the cover and contributed to a crinkling noise when the seat was occupied by a seat occupant. Secondly, the plastic bag inhibited the breathability of the seat, that is, the ability of the seat to allow the passage of moisture from the vehicle seat occupant through the seat.

SUMMARY OF THE INVENTION

To overcome the above-noted and other problems, the present inventive method and apparatus is brought forth. The present inventive method in its preferred embodiment has a stand for placement of the bun assembly. Surrounding the bun assembly is a bag made from an impermeable and flexible membrane material, typically a polymeric (plastic) material such as a neoprene coated nylon fabric aluminized nylon or polypropylene. The plastic bag has basically an open cylindrical shape with one end fixed with the stand. The interior of the bag will be exposed to a vacuum causing it to adhere to the bun assembly and to collapse the bun assembly. The vacuum is lowered or released or a slight inflation is provided to lower the adhesion of the bag to the bun assembly. The bun assembly is then physically ejected in a direction away from the stand and the bag being fixed with respect to the stand is pulled away from between the cover and the bun assembly as the bun assembly is ejected outward.

It is an object of the present invention to provide a method of enveloping vehicle seat polymeric foam bun assemblies with envelope type covers and also providing an apparatus to do the same.

It is an object of the present invention to provide a method of enclosing an elastomeric foam bun assembly with a prefitted membrane cover, the method including enclosing the bun assembly with a generally impermeable membrane having a lower coefficient of friction with the bun assembly than the cover with the bun assembly, subjecting the bun assembly to a vacuum to contract the bun assembly and to adhere the impermeable membrane to the bun assembly, enclosing the bun assembly and the impermeable membrane with the cover, and translating the impermeable membrane relative to the bun assembly from between the cover and the bun assembly.

It is an object of the present invention to provide a method of enclosing a vehicle seat elastomeric foam bun assembly with a prefitted membrane cover having a compression fit with the bun assembly, the method including placing the bun assembly on a stand, enclosing the bun assembly with a generally impermeable cylindrical bag having a lower coefficient of friction with the bun assembly foam then the cover with the bun assembly, connecting a first end of said bag with a vacuum to sealably adhere the bag to the bun assembly and to contract the bun asembly, enclosing the bun assembly and the bag with the cover, releasing the bun assembly from the vacuum, and removing the membrane from between the cover and the foam assembly by translating the foam bun assembly while retaining the first end of the bag in a fixed position.

It is an object of the present invention to provide an apparatus for assembling a prefitted membrane cover to a vehicle seat foam bun assembly, the apparatus including means to support the bun assembly, an impermeable membrane to enclose the bun assembly membrane the impermeable membrane having an end fixed with the support means and an opposite open end, selective vacuum means connected with the impermeable membrane for contacting the bun assembly and adhering the impermeable membrane to the bun assembly to allow the cover to be placed over the bun assembly, and ejector means for ejecting the bun assembly out of the impermeable membrane whereby the impermeable membrane is removed from between the cover and the bun assembly.

An advantage of the present inventive method is that there is not any plastic bag between the cover and the seat bun after assembly. The manual labor involved is greatly reduced or, if desired, can be totally eliminated. The interference or compression fit of the seat cover over the bun assembly can be increased, thereby providing a more aesthetically pleasing seat.

Other objects and advantages of the present invention can become more apparent to those skilled in the art as the nature of the invention is better understood in the accompanying drawings and detailed description.

DETAILED DESCRIPTION OF THE DRAWINGS

Figure 1:
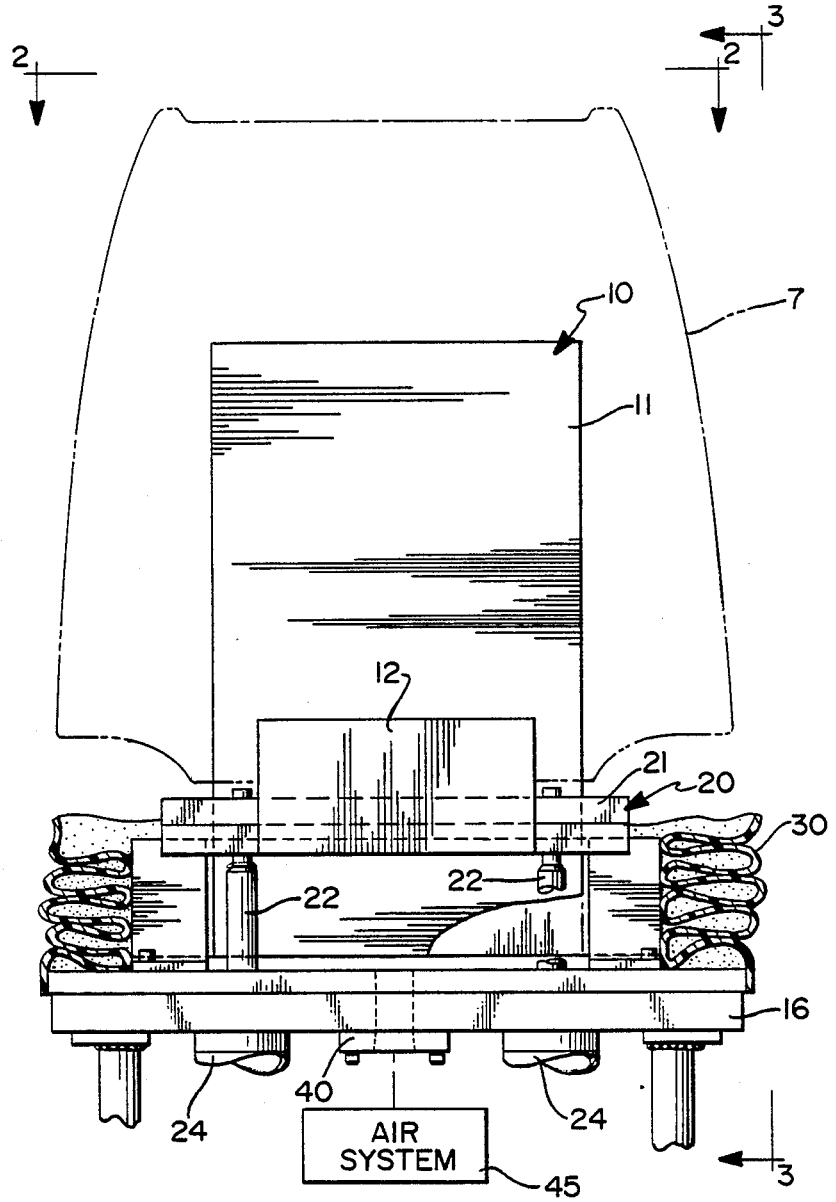
FIG. 1 is a sectional view mainly in front elevational of a preferred embodiment apparatus according to the present invention.
Figure 2:
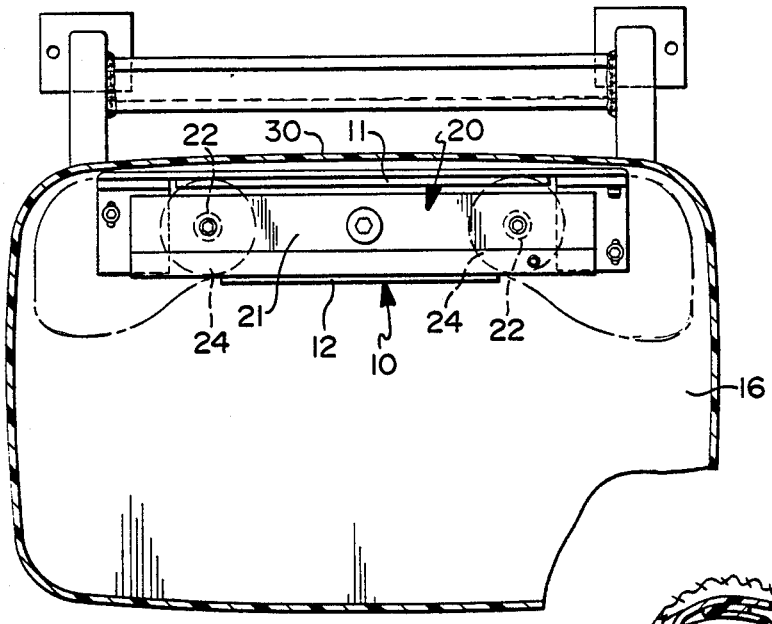
FIGS. 2 and 3 are views taken along lines 2—2 and 3—3 respectively.
Figure 3:
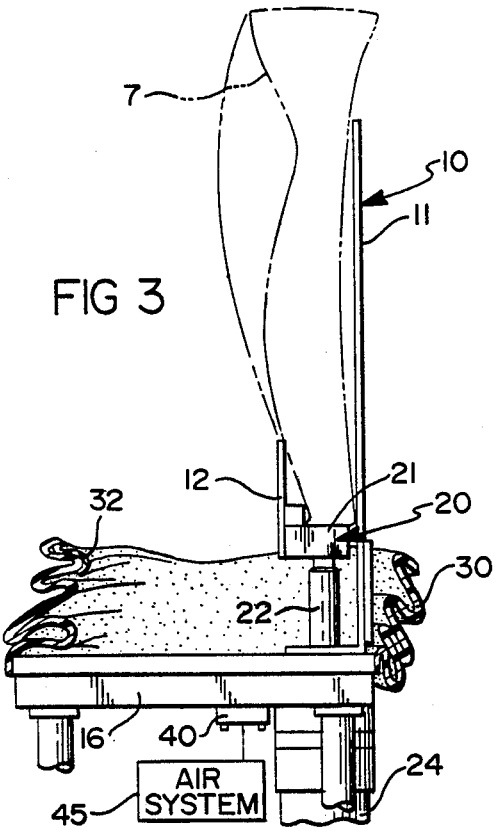

Referring to FIGS. 1, 2 and 3 the vehicle seat bun assembly 7 is placed in a supporting means supplied by on a stand 10. As illustrated the seat bun assembly 7 is a vehicle seat back, however, it could be various other parts of the vehicle seat which utilize a polymeric foam bun. preferably the polymeric foam of the bun assembly should be open celled and have a cure density of approximately 1.5 to 3 lbm/ft3. Also the foam should not have a sealed surface. The stand 10 has a rearward 11 which project upwards from a base 16. The rearward plate 11 is fixed to base 16. The stand 10 has a air fitting 40 for connection with a vacuum means and to an optional compressed air system 45.

The stand 10 has connected to the base 16 an ejector means or system 20. The ejector 20 has a head 21 for placement of the bun assembly 7. The head 21 has a front plate 12. The head 21 is extendible by rod 22 in a direction away from the base 16. Rod 22 is powered by air cylinders 24.

Figure 4:
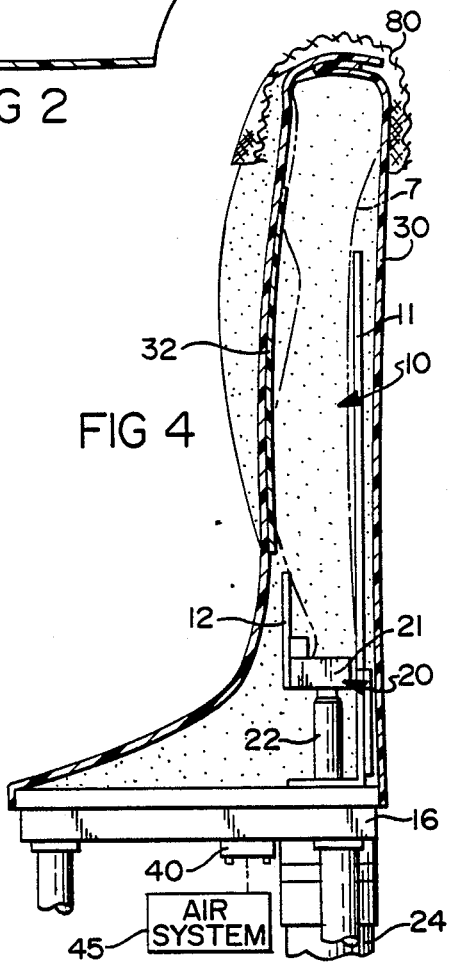
FIGS. 4 and 5 are views similar to those of FIG. 3 illustrating various stages of the inventive method.
Figure 5:
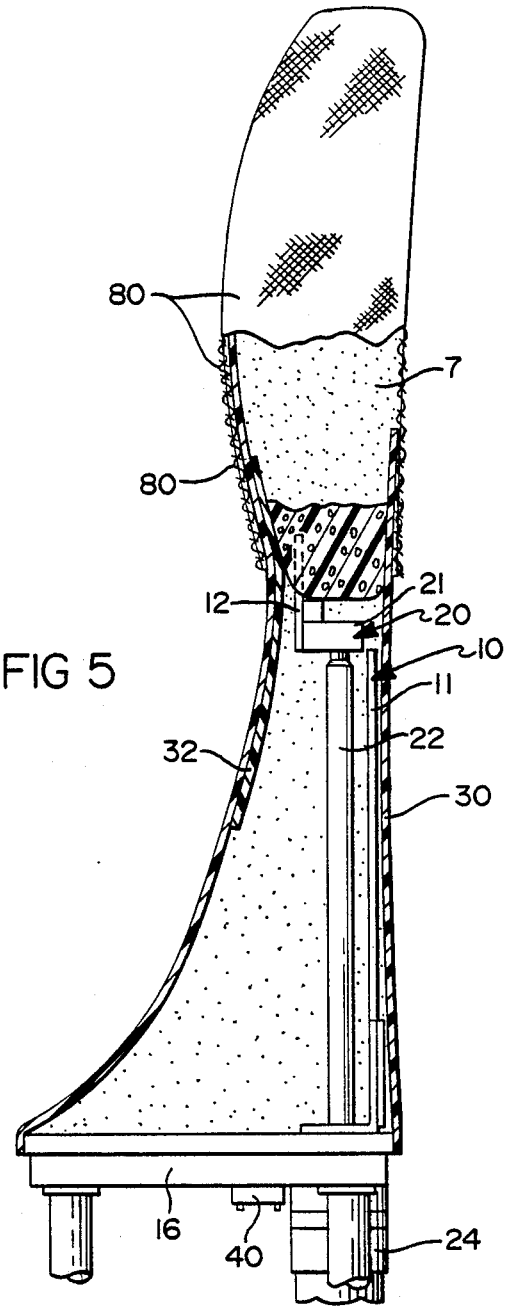

Fixably connected along its lower (first) end edge with the stand 10 is a flexible membrane cylindrical envelope 30. The envelope 30 is typically an impermeable polymeric material such as neoprene coated nylon fabric or aluminum coated fiber glass. At an upper end, the envelope 30, commonly referred to as bag, will be opened to allow the bun assembly 7 to be placed therein and to allow the envelope 30 to assume an overlapping relationship with the bun assembly 7 (FIG. 4). The envelope 30 has lower coefficient of friction with the foam of the bun assembly 7 than the coefficient of friction of the prefitted cover 80 with the foam of the bun assembly 7. The envelope 30 along its end opposite the base 16 can be perforated if desired. Additionally the envelope 30 can be fitted as required for various sized or shaped bun assemblies.

In operation the bun assembly 7 is placed on the stand 10 on top of the ejector head 21 between the forward 12 and rearward plates 11 (FIG. 3). Rod 22 is in a retracted position and the bun assembly 7 rest on top of head 21.

The envelope 30 is wrapped manually by an operator around the bun assembly 7 to enclose the same. (This process can be automated if desired.) The ends of the envelope 30 are folded over the top of the bun assembly 7 (FIG. 4).

The air system 45 is turned on and supplies a vacuum via fitting 40 causing the envelope 30 to sealably adhere to the bun assembly 7 and to compress the same. The vacuum will typically be a range of 10 to 25 inches of mercury. The bun assembly and envelope 30 are now enclosed by the cover 80. A manually activated or automatic switch (not shown) will cut off the vacuum and optionally supply compressed air in the range of 0–20 psi optional mm of mg. The compressed air causes the envelope 30 to be slightly pushed away from the bun assembly 7 however the envelope 30 is still captured by the cover 80. The ejector 20, simultaneously or after a short delay, is then activated. The activation of the ejector 20 causes the translation of the foam bun assembly 7 and cover 80 upwards. The envelope 30 affixed to the base 16 will then be translated from between the cover 80 and the bun assembly 7 and the operation is complete. In an alternative embodiment, translation of the envelope with respect to the cover and bun assembly may be accomplished by holding the bun assembly stationary and pulling the envelope downward.

The bun assembly often will have strips of Velcro ® hook fasteners to aid the adherence of the cover to the bun assembly. The Velcro ® strips can sometimes cause excessive wear or damage to the envelope 30. To alleviate the above, strips of polyethylene or polypropylene inserts 32 can be sewn inside the envelope 30.

While an embodiment of the present invention has been explained it will be readily apparent to those skilled in the art of the various modifications which can be made to the present invention without departing from the spirit and scope of this application as it is encompassed by the following claims.

The embodiments of the invention in which an exclusive property or privilege is claimed are defined as follows:

1. A method of enclosing an elastomeric foam bun assembly with a prefitted membrane cover, said method in combination comprising:

enclosing said bun assembly with a generally impermeable membrane, said impermeable membrane having a lower coefficient of friction with said bun assembly than said cover with said bun assembly;

subjecting said bun assembly to a vacuum to contract said bun assembly and to adhere said impermeable membrane to said bun assembly;

enclosing said bun assembly and said impermeable membrane with said cover; and removing said impermeable membrane from between said cover and said bun assembly by translating said impermeable membrane relative to said bun assembly.

2. A method of enclosing a vehicle seat elastomeric foam bun assembly with a prefitted membrane cover having a compression fit with said bun assembly, said method in combination comprising:

enclosing said bun assembly with a generally impermeable membrane having a lower coefficient of friction with said bun assembly than said cover with said bun assembly and said impermeable membrane having a generally fixed end and a second open end foldable over said bun assembly;

subjecting said bun assembly to a vacuum to contract said bun assembly and to adhere said impermeable membrane to said bun assembly;

enclosing said bun assembly and said impermeable membrane with said prefitted cover; and ejecting said bun assembly out of said open end of said impermeable membrane while holding said fixed end of said impermeable membrane to remove said impermeable membrane from between said prefitted cover and said bun assembly.

3. A method of enclosing a vehicle seat elastomeric foam bun assembly with a prefitted membrane cover having a compression fit with said bun assembly, said method in combination comprising:

placing said bun assembly on a stand;

enclosing said bun assembly with a generally impermeable cylindrical bag having a lower coefficient of friction with said bun assembly foam than said cover with said bun assembly;

connecting a first end of said bag with a vacuum to sealably adhere said bag to said bun assembly and to contract said bun assemby;

enclosing said bun assembly and said bag with said cover;

releasing said bun assembly from said vacuum; and removing said membrane from between said cover and said bun assembly by translating said bun assembly while retaining said first end of said bag in a fixed position.

4. A method as described in claim 3 further including inflating said bun assembly to end the adherence of said bag to said bun assembly.

5. An apparatus for assembling prefitted membrane cover to a vehicle seat foam bun assembly, said apparatus in combination comprising:

means to support said bun assembly;

an impermeable membrane to enclose said cover, said impermeable membrane having an end fixed with said support means and said impermeable membrane having an opposite open end;

selective vacuum means connected with said impermeable membrane for contacting said bun assembly and adhering said impermeable membrane to said bun assembly to allow said cover to be placed over said bun assembly; and ejector means for ejecting said bun assembly out of said impermeable membrane whereby said impermeable membrane is removed from between said cover and said bun assembly.

6. An apparatus as described in claim 5 wherein said impermeable membrane comprises an aluminum coated fiber glass.

7. An apparatus as described in claim 5 wherein said impermeable membrane has protective strips.

* * * * *